US011186884B2

(12) United States Patent
Hummelshøj

(10) Patent No.: US 11,186,884 B2
(45) Date of Patent: Nov. 30, 2021

(54) ASSEMBLY COMPONENT

(71) Applicant: Expanite Technology A/S, Hillerød (DK)

(72) Inventor: Thomas Strabo Hummelshøj, Frederiksberg (DK)

(73) Assignee: EXPANITE TECHNOLOGY A/S, Hillerød (DK)

( * ) Notice: Subject to any disclaimer, the term of this patent is extended or adjusted under 35 U.S.C. 154(b) by 0 days.

(21) Appl. No.: 16/605,070

(22) PCT Filed: Apr. 26, 2017

(86) PCT No.: PCT/DK2017/050123
§ 371 (c)(1),
(2) Date: Oct. 14, 2019

(87) PCT Pub. No.: WO2018/196931
PCT Pub. Date: Nov. 1, 2018

(65) Prior Publication Data

US 2020/0040416 A1 Feb. 6, 2020

(51) Int. Cl.
*C22C 38/18* (2006.01)
*C21D 1/74* (2006.01)
(Continued)

(52) U.S. Cl.
CPC ..... *C21D 1/74* (2013.01); *C21D 7/02* (2013.01); *C21D 8/005* (2013.01); *C22C 38/18* (2013.01);
(Continued)

(58) Field of Classification Search
None
See application file for complete search history.

(56) References Cited

U.S. PATENT DOCUMENTS 5,503,687 A 4/1996 Berns
2018/0221536 A1* 8/2018 Chen ..... A61F 2/24

FOREIGN PATENT DOCUMENTS

EP 0480033 A1 4/1992
WO 2006134541 A1 12/2006
(Continued)

OTHER PUBLICATIONS

Washko and Aggen, "Wrought Stainless Steels", 1990. ASM Handbook, vol. 1: Properties and Selection: Irons, Steels, and High-Performance Alloys, ASM Handbook Committee, p. 841-907, DOI: 10.31399/asm.hb.v01.a0001046 (Year: 1990).*
(Continued)

*Primary Examiner* — Patricia L. Hailey
*Assistant Examiner* — Christopher D. Moody
(74) *Attorney, Agent, or Firm* — Buchanan Ingersoll & Rooney P.C.

(57) ABSTRACT

The present invention relates to an assembly component of an alloy based on iron, nickel and/or cobalt containing at least 10% (w/w) chromium, the assembly component having an annular shape with an inner surface and an outer surface and a thickness between the inner surface and the outer surface in the range of 0.1 mm to 5 mm, the alloy having a content of nitrogen in solid solution providing a microhardness in the range of 250 $HV_{0.05}$ to 370 $HV_{0.05}$ at a depth from the surface in the range of 0 μm to 100 μm. The invention also relates to an assembly with the assembly component.

18 Claims, 6 Drawing Sheets

(51) Int. Cl.
*C21D 7/02* (2006.01)
*C21D 8/00* (2006.01)

(52) U.S. Cl.
CPC ..... *C21D 2201/00* (2013.01); *C21D 2241/00* (2013.01)

(56) References Cited

FOREIGN PATENT DOCUMENTS

| | | | |
|---|---|---|---|
| WO | 2012146254 | A1 | 11/2012 |
| WO | 2013159781 | A1 | 10/2013 |
| WO | 2015173380 | A1 | 11/2015 |

OTHER PUBLICATIONS

Communication pursuant to Article 94(3) EPC dated Oct. 13, 2020, by the European Patent Office in corresponding European Patent Application No. 17 721 519.1. (3 pages).
Bashchenko, et al., "Allowing Iron and Its Alloys With Nitrogen Under High Pressure", Izvestiya Akademii Nauk SSSR. Metally, No. 4, 1985, pp. 173-178.
Georgiev, et al., "Nitrogen Solubility in 1.4306 and 1.4435 Austenitic Steels", Journal of Materials Science and Technology, vol. 4, No. 4, 1996, pp. 28-32.
International Search Report (PCT/ISA/210) and Written Opinion (PCT/ISA/237) dated Jan. 15, 2018, by the European Patent Office as the International Searching Authority for International Application No. PCT/DK2017/050123.

* cited by examiner

ASSEMBLY COMPONENT

FIELD OF THE INVENTION

The present invention relates to an assembly component of an alloy based on iron, nickel and/or cobalt containing at least 10% (w/w) chromium, and to an assembly comprising the assembly component. The assembly component advantageously provides a gas tight seal in an assembly of gas pipes.

PRIOR ART

Stainless steel components are generally considered "stainless" due to the high, e.g. 10% (w/w) or more, content of chromium that forms a protective oxide layer on the surface, which provides corrosion resistance. Moreover, steels generally have high strength, and in particular cold deformation of a steel component will increase its strength compared to a steel component prepared without cold deformation. Both characteristics are commonly desirable but modification of one characteristic will normally be at the expense of the other. Several attempts have been described in the literature to provide strong components of stainless steel, which are also corrosion resistant.

U.S. Pat. No. 5,503,687 discloses a thermal treatment process to form an austenitic surface and near surface layer having 0.30% by weight dissolved nitrogen in a stainless steel component that nearly has its final shape. The process includes enriching a component with nitrogen at a temperature of from 1000° C. to 1200° C. in a nitrogen-containing gas atmosphere; and subsequently quenching the component at such a rate that nitride separation is avoided. Preventing nitride separation provides corrosion resistance to the treated component. However, if a cold deformed workpiece is treated according to this method the core strength obtained from the cold deformation will be annihilated due to the treatment at above 1000° C.

WO 2006/134541 describes a method for making a three-dimensional finished steel product with a thickness of less than 3 mm by deformation. The method comprises forming a sheet of stainless steel with a microstructure consisting predominantly of ferrite, austenite, martensite or a mixture thereof to a three dimensional shaped product and treating the shaped product with a nitrogen-containing atmosphere at a temperature of between 1000° C. and 1200° C. to saturate the product through the thickness with a nitrogen content between a lower limit of 0.3 wt % and an upper limit that is provided by the beginning of nitride separation, quenching the product at such a rate and nitrogen pressure that nitride separation is avoided and subsequently machining, e.g. cutting or drilling, the nitrogen saturated shaped product to the finished steel product. Since the product is saturated with nitrogen the subsequent machining is not limited to a surface treatment, but allows drilling and cutting without destroying the corrosion resistance obtained by the solution nitriding process, and the saturation with nitrogen further allows that a core strength is retained despite the high temperature treatment.

WO 2012/146254 discloses a method similar to WO 2006/134541. In addition to the high temperature nitrogen treatment the method comprises a further hardening by dissolving nitrogen or carbon at a temperature below the temperature where carbides or nitrides form in the treated alloy, which leads to formation of expanded austenite or expanded martensite in the treated material. The combination of high and low temperature nitriding can compensate for the loss of strength caused by annihilating the cold deformation at the high temperature while retaining corrosion resistance.

For certain applications of stainless steel it is desirable to manipulate the characteristics further than allowed by the methods of the prior art. Gas pipes, for example, require junctions between individual sections of piping which junctions are both gas tight and free from corrosion. It is an object of the present invention to provide an improved assembly component of a stainless steel alloy.

DISCLOSURE OF THE INVENTION

The present invention relates to an assembly component of an alloy based on iron, nickel and/or cobalt containing at least 10% (w/w) chromium, the assembly component having an annular shape with an inner surface and an outer surface and a thickness between the inner surface and the outer surface in the range of 0.1 mm to 5 mm, the alloy having a content of nitrogen in solid solution providing a microhardness in the range of 250 $HV_{0.05}$ to 370 $HV_{0.05}$ at a depth from the surface in the range of 0 μm to 100 μm.

The assembly component of the invention is suited to provide a gas tight seal, e.g. for use in high pressure gas pipes or the like. The present inventor has now surprisingly found that when the assembly component of the invention is exposed to cold deformation, i.e. a plastic deformation induced in the material by external forces at a temperature below the recrystallisation temperature, in particular at ambient temperature, the tensile strength of the material may be up to three times higher than the tensile strength for a cold deformed assembly component which has not been exposed to a high temperature nitrogen dissolution treatment. The improved tensile strength is particularly advantageous for an assembly component for sealing a high pressure gas pipe. Thus, the invention provides a corrosion resistant assembly component of an improved tensile strength.

The effect of the invention is observed when the assembly component has a microhardness in the range of 250 $HV_{0.05}$ to 370 $HV_{0.05}$ at a depth from the surface in the range of 0 μm to 100 μm. The material at the depth from the surface in the range of 0 μm to 100 μm may also be referred to as the "hardened layer", but the hardened layer may also have a greater thickness than 100 μm so that the depth at which the microhardness is 250 $HV_{0.05}$ may define the thickness of the hardened layer. For example, the assembly component may have a microhardness at or adjacent to the surface of 350 $HV_{0.05}$ and a core hardness in the range of 180 $HV_{0.05}$ to 220 $HV_{0.05}$, and the thickness of the hardened layer will correspond to the depth at which the microhardness is 250 $HV_{0.05}$, which may be at a depth from the surface of 200 μm or 300 μm or more. If the microhardness at the depth of 100 μm is below 250 $HV_{0.05}$, i.e. if the hardened layer has a thickness below 100 μm, the assembly component cannot provide a gas tight seal after exposing to cold deformation. The upper range of the microhardness may vary for other alloys, and in other embodiments the microhardness is in the range of 250 $HV_{0.05}$ to 350 $HV_{0.05}$ at a depth from the surface in the range of 0 μm to 100 μm, e.g. in the range of 250 $HV_{0.05}$ to 340 $HV_{0.05}$ at a depth from the surface in the range of 0 μm to 100 μm.

The assembly component of the invention, in particular the hardened layer, has a content of nitrogen in solid solution. The microhardness of the hardened layer correlates with the content of nitrogen so that the higher the content of nitrogen the higher the microhardness of the hardened layer. The microhardness of the assembly component is typically highest at the surface of the assembly component and decreasing to the core microhardness of the alloy at greater depths, e.g. at depths above 100 μm.

In a preferred embodiment the microhardness of the hardened layer is in the range of 280 $HV_{0.05}$ to 320 $HV_{0.05}$, e.g. the microhardness at a depth of 100 μm from the surface is 280 $HV_{0.05}$. For example, the microhardness at a depth of 200 μm from the surface may be 250 $HV_{0.05}$.

In general, the nitrogen content of the hardened layer may be in the range of 0.1% (w/w) to 0.8% (w/w). Thus, in an embodiment, the nitrogen content is in the range of 0.1% (w/w) to 0.8% (w/w) at a depth from the surface in the range of 0 μm to 100 μm, in particular in the range of 0.4% (w/w) to 0.8% (w/w) at a depth from the surface in the range of 0 μm to 100 μm. The present inventor has surprisingly found that the effect of the invention is observed for a nitrogen content until the point of separation of nitrides, i.e. 0.8% (w/w), corresponding to a surface hardness of up to 370 $HV_{0.05}$, but more typically about 320 $HV_{0.05}$. If the nitrogen content is above 0.8% (w/w) nitride separation occurs and the assembly component is not corrosion resistant. In particular, the nitrogen is in solid solution and the hardened layer generally does not contain any nitrides so that the assembly component is free from nitrides, which is considered advantageous since this ensures corrosion resistance. The nitrogen content should be in the range of 0.1% (w/w) to 0.8% (w/w). A preferred range of nitrogen contents is 0.5% (w/w) to 0.7% (w/w).

The core of the material may have lower content of nitrogen. A nitrogen content of 0.2% (w/w) typically corresponds to a microhardness of 220 $HV_{0.05}$, and the assembly component of the invention can be considered to have a nitrogen content in the hardened layer in the range of 0.1% (w/w) to 0.8% (w/w), in particular in the range of 0.4% (w/w) to 0.8% (w/w) at a depth from the surface in the range of 0 μm to 100 μm.

The actual microhardness also depends on the specific alloy, and the nitrogen content for reaching a microhardness of 250 $HV_{0.05}$ may vary for different alloys. Determination of the correlation between nitrogen content and microhardness is known by the skilled person. Table 1 shows the correlation between nitrogen content and microhardness for austenitic AISI 308 stainless steel. The microhardnesses in Table 1 were determined for samples saturated with nitrogen at the indicated levels, so that the nitrogen contents were uniform over the thicknesses of the samples.

TABLE 1

Correlation between the content of nitrogen and the microhardness for AISI 308 stainless steel

| Content of nitrogen (%(w/w)) | Microhardness ($HV_{0.05}$) |
|---|---|
| 0.1 ± 0.01 | 199 |
| 0.2 ± 0.02 | 215 |
| 0.3 ± 0.03 | 222 |
| 0.4 ± 0.04 | 233 |
| 0.5 ± 0.05 | 250 |
| 0.6 ± 0.06 | 273 |
| 0.7 ± 0.07 | 289 |
| 0.8 ± 0.08 | 308 |

In a specific embodiment, the hardness is uniform over the thickness of the assembly component, e.g. the hardness has an average, as determined from at least 5 microhardness measurements, and the at least 5 microhardness measurements deviate with up to 15%, e.g. up to 10%, from the average hardness. In this embodiment the nitrogen content likewise has a deviation over the thickness of up to 15%, e.g. the assembly component has an average nitrogen content as determined from at least 5 measurements, which at least 5 nitrogen measurements deviate with up to 15%, e.g. up to 10%, from the average nitrogen content. For example, the average nitrogen content may be in the range of 0.1% (w/w) to 0.8% (w/w), such as in the range of 0.5% (w/w) to 0.7% (w/w). When the hardness is uniform over the thickness of the assembly component the assembly component can thus be considered to be saturated with nitrogen over the thickness. In the context of the invention the term "saturated" and its derived forms means that the content of nitrogen reaches an equilibrium during the treatment at the dissolution temperature so that the deviation in the nitrogen content over the thickness of the material will be minimal, i.e. up to 15%, or preferably up to 10%. The actual nitrogen content can be controlled from the dissolution temperature and the partial pressure of $N_2$ during the dissolution treatment. Thus, in an embodiment of the invention the content of nitrogen in solid solution is 0.3% (w/w)±0.045% (w/w), e.g. by weight of the total weight of the component, and in another embodiment the content of nitrogen in solid solution is 0.5% (w/w) ±0.075% (w/w), e.g. by weight of the total weight of the component. In further embodiments the content of nitrogen in solid solution is 0.35% (w/w)±0.035% (w/w), 0.4% (w/w)±0.04% (w/w), 0.45% (w/w)±0.045% (w/w), 0.50% (w/w)±0.05% (w/w), 0.55% (w/w)±0.055% (w/w), 0.60% (w/w)±0.06% (w/w), 0.65% (w/w)±0.065% (w/w), 0.70% (w/w)±0.07% (w/w), 0.75% (w/w)±0.075% (w/w) e.g. of the total weight of the component.

Nitrogen is typically dissolved into the alloy at a high temperature, and in another aspect the invention relates to a method of producing an assembly component of the invention. The method comprising the steps of:

- providing a component of an alloy based on iron, nickel and/or cobalt containing at least 10% (w/w) chromium, the component having an annular shape with an inner surface and an outer surface and a thickness between the inner surface and the outer surface in the range of 0.1 mm to 5 mm,
- placing the component in a nitrogen containing atmosphere,
- heating the component to a dissolution temperature in the range of 1000° C. to 1200° C.,
- maintaining the component at the dissolution temperature in the nitrogen containing atmosphere for a duration in the range of 0.5 hours to 40 hours,
- cooling the component from dissolution temperature to ambient temperature to provide the assembly component with the cooling from 900° C. to 500° C. being performed within 60 seconds.

The component may be placed in the nitrogen containing atmosphere preheated to the dissolution temperature, e.g. with the component being at ambient temperature, or the component may be heated in the nitrogen containing atmosphere. It is also possible to heat the component, e.g. from ambient temperature, in an inert atmosphere, e.g. argon. Regardless of how the component is heated the treatment at the dissolution temperature will remove nitrides formed in the alloy of the component, and due to the quenching the nitrogen dissolved in the alloy at the dissolution temperature will remain in solid solution. By heating the component to the dissolution temperature in an inert gas not comprising nitrogen, e.g. argon, it is possible to achieve better control of the dissolution of nitrogen into the alloy, e.g. with respect to the dissolution depth, so that the thickness of the hardened layer can be controlled.

The component is maintained at the dissolution temperature in the nitrogen containing atmosphere for a duration sufficient for the content of nitrogen in the component to reach the desired level at the desired depth, i.e. to ensure that the microhardness of the component will achieve a value of microhardness in the range of 250 $HV_{0.05}$ to 370 $HV_{0.05}$ at a depth from the surface in the range of 0 μm to 100 μm. The treatment at the dissolution temperature will generally provide an annealing of the component over the thickness of the component so that the component will be austenised. Thereby the cross-section of the component will have a visually uniform appearance. Dissolution of nitrogen into the component will take place at a slower rate than penetration of heat into the material so that the component may have a core microhardness in the range of 150 $HV_{0.05}$ to 220 $HV_{0.05}$, corresponding to a nitrogen content below 0.1% (w/w) and a microhardness in the range of 250 $HV_{0.05}$ to 370 $HV_{0.05}$ at a depth from the surface in the range of 0 μm to 100 μm, corresponding to a nitrogen content in the range of 0.2% (w/w) to 0.8% (w/w), in particular 0.4% (w/w) to 0.8% (w/w).

A duration of 0.5 hours will be sufficient to provide a microhardness of 250 $HV_{0.05}$ at a depth of 100 μm, e.g. when the dissolution temperature is in the range of 1050° C. to 1150° C., regardless of the thickness of the assembly component. The microhardness at or near the surface will typically be in the range of 280 $HV_{0.05}$ to 320 $HV_{0.05}$ after a duration of 0.5 hours. By increasing the duration, e.g. to 1 hour, 2 hours, 3 hours, the nitrogen will be inserted to a greater depth, e.g. the depth where the microhardness is 250 $HV_{0.05}$ will typically be at about 150 μm, about 200 μm or about 250 μm, respectively.

At a dissolution temperature in the range of 1075° C. to 1125° C., e.g. about 1100° C., the solubility of nitrogen in the steel is considered higher than when the dissolution temperature is in the range of from 1125° C. to 1175° C., so that nitrogen can be dissolved faster, e.g. to a greater depth in a shorter time, at a dissolution temperature in the range of 1075° C. to 1125° C. than at temperatures above 1125° C. Thus, in one embodiment the dissolution temperature is in the range of 1075° C. to 1125° C., e.g. 1100° C., and the duration is at least 0.5 hours. In another embodiment the dissolution temperature is in the range of 1125° C. to 1175° C., e.g. 1150° C., and the duration is at least 1 hour.

The skilled person can calculate the partial pressure of $N_2$, the temperature and the duration required to obtain a desired nitrogen content, e.g. as explained by Georgiev et al, Journal of Materials Science and Technology, Vol. 4, 1996, No. 4, pp. 28 and Bashchenko et al, Izvestiya Akademii Nauk SSSR. Metally, no 4, 1985, pp. 173-178, which are hereby incorporated by reference.

In a specific embodiment the nitrogen content in the component will be allowed to reach an equilibrium with the nitrogen containing atmosphere. Thereby the component will be saturated with nitrogen over its thickness. The equilibrium content will be in the range of 0.1% (w/w) to 0.8% (w/w) by weight of the total weight of the component and the nitrogen content will deviate up to 15%, e.g. up to 10%, over the thickness of the material of the component as described above. The actual equilibrium content, i.e. the "saturated nitrogen content", will depend on the partial pressure of nitrogen in the nitrogen containing atmosphere so that the nitrogen content can be controlled to be e.g. in the range of 0.4% (w/w)±0.04% (w/w) to 0.8% (w/w)±0.08% (w/w) by weight of the total weight of the component. Correlations between the partial pressure of $N_2$ and the obtained saturation content of N in the alloy are summarised in Table 2.

TABLE 2

Correlation between partial pressure and saturation levels of nitrogen

| Partial pressure of $N_2$ (bar) | Saturation level of nitrogen (%(w/w)) |
|---|---|
| 0.01 | 0.1 ± 0.01 |
| 0.05 | 0.2 ± 0.02 |
| 0.1 | 0.3 ± 0.03 |
| 0.3 | 0.4 ± 0.04 |
| 0.4 | 0.5 ± 0.05 |
| 0.6 | 0.6 ± 0.06 |
| 0.9 | 0.7 ± 0.07 |
| 1.1 | 0.8 ± 0.08 |

The nitrogen containing atmosphere may be selected freely as long as it comprises a nitrogen containing species. It is preferred that the nitrogen containing atmosphere comprises or is $N_2$. However, it is expected that any nitrogen containing gaseous species when heated to the dissolution temperature will decompose into $N_2$ and other components, and any nitrogen containing gaseous species may be employed. The nitrogen containing atmosphere may further comprise carbon. For example, the nitrogen containing atmosphere may comprise or consists of a gaseous species containing both nitrogen and carbon, or the nitrogen containing atmosphere may comprise a separate carbon containing gaseous species, e.g. CO or $CO_2$. When a nitrogen containing species other than $N_2$ is employed it is a simple matter for the skilled person to calculate the partial pressure of $N_2$ at the dissolution temperature from the partial pressure of the nitrogen containing species.

The duration to reach the equilibrium will depend on the dissolution temperature and on the thickness of the assembly component. The duration required to reach equilibrium can be determined by the skilled person but will typically be in the range of 3 hours to 40 hours, e.g. 5 hours to 24 hours, e.g. in the range of 10 to 15 hours, or in the range of 15 to 20 hours.

Treatment at the dissolution temperature for a duration of at least 0.5 hours will also ensure that any nitrides, and carbides, if carbon is present in the alloy, are dissolved so that nitrogen, and optionally carbon, will be in solid solution.

The cooling after the dissolution process at the dissolution temperature takes place especially quickly, e.g. in a period of 60 seconds or less, in the temperature interval in which there is the largest tendency for sensitisation and formation of precipitations, such as of nitrides and optionally carbides if carbon is present, for the relevant alloy. For alloys of the invention, e.g. stainless steel, it has been found that this in particular takes place in the interval from 900° C. to 500° C. where the material should be cooled quickly. In one embodiment the component is cooled from 900 to 500° C. in less than 60 seconds, e.g. in less than 30 seconds or in less than 20 seconds. Thereby the formation of nitrides and carbides, if carbon is present, is substantially avoided, and this is an advantage since these can react with the alloying elements in stainless steel, such as chromium. The depletion of alloying elements from solid solution and binding of these as nitrides and also carbides is suppressed and the corrosion resistance characteristics are maintained. In general, the higher the nitrogen content the quicker the cooling to prevent formation of nitrides.

The cooling may be effected using any cooling method, e.g. by cooling in a gas or a liquid. For example, the component may be cooled in a molten salt, oil or in water or an aqueous solution.

The dissolution step is performed in a gas, such as a gas containing $N_2$, e.g. substantially pure $N_2$ without other gasses than unavoidable impurities, and the cooling step may also be performed in a gas, which may be the same gas as that used in the first dissolution step. However, it is preferred that the gas in the cooling step is an inert gas not containing nitrogen (a nitrogen-free inert gas) with argon being particularly preferred. In the context of the invention an "inert gas" is a gas that does not contain any substantial amount of molecules which interact with elements of the alloy; any inert gas not containing nitrogen is contemplated in the invention, or mixtures of gasses. When an inert gas not containing nitrogen is employed in the cooling step the method of the invention will provide a corrosion resistance, which is even superior to the corrosion resistance obtained using other cooling gases, or when the cooling step is performed using other methods. In particular, gasses containing nitrogen are believed to accelerate formation of nitrides when the cooling is performed in a gas containing nitrogen compared to cooling in an inert gas, so that a more robust and flexible method is provided with a cooling step using an inert gas. Cooling in a nitrogen-free inert gas may also allow longer cooling times than 60 s, but preferably cooling is performed a nitrogen-free inert gas in less than 30 s, such as in less than 10 s.

In an embodiment the alloy is selected from the group comprising stainless steel, austenitic stainless steel, martensitic stainless steel, ferritic stainless steel, precipitation hardenable (PH) stainless steel or ferritic-austenitic stainless steel. Austenitic stainless steel is particularly preferred.

When the assembly component is employed to provide a gas tight seal, e.g. in a connection between two pipes, the assembly component may also be referred to as a "ferrule". An assembly of two gas pipes using an assembly component, e.g. a ferrule, of the invention may comprise any additional component traditionally used in the field. The assembly component, e.g. a "front ferrule", may be used together with a further assembly component, also of the invention, which may be referred to as a "back ferrule". Thus, the assembly of the invention may comprise a front ferrule or a front ferrule and a back ferrule, or the assembly component may be a front ferrule or the assembly component may be a back ferrule. When the assembly comprises a front ferrule and a back ferrule, both the front ferrule and the back ferrule may be assembly components of the invention. Front ferrules and back ferules are known in the art.

The assembly component of the invention has an annular shape with an inner surface and an outer surface and a thickness between the inner surface and the outer surface in the range of 0.1 mm to 5 mm. If the thickness is below 0.1 mm the assembly component does not have sufficient tensile strength for being used as an assembly component. If the thickness is above 5 mm the effect from the increased tensile strength in relation to the thickness of the hardened layer does not provide a gas tight seal when used as a ferrule, and moreover the deviation of the content of nitrogen in solid solution cannot be maintained within the deviation of 15%, and the properties of the material will not be uniform over the thickness. When the thickness is in the range of 0.1 mm to 5 mm the hardened layer provides an optimal effect when the assembly component is employed to provide a gas tight seal, in particular when the hardness is uniform over the thickness of the material. In a preferred embodiment the thickness between the inner surface and the outer surface in the range of 0.5 mm to 4 mm, such as in the range of 1 mm to 3 mm, e.g. about 1 mm, about 2 mm or about 3 mm.

The annular shape of the assembly component can be chosen freely, and likewise the cross section of the assembly component can have any shape as desired. For example, the assembly component may have a cylindrical shape and the cross-section of the material of the cylindrically shaped assembly component may be rectangular or triangular. In an embodiment the assembly component has frustoconical annular shape defining a narrow end and a wide end. When the assembly component has a frustoconical shape the cross-sectional shape of the material of the assembly component may be rectangular. In a preferred embodiment the cross-sectional shape of the material of the frustoconical assembly component is triangular with the narrow end of the triangle facing the narrow end of the frustocone.

For gas pipes and similar uses, it is critical that the alloy is corrosion resistant, e.g. that it has a corrosion resistant surface, and in order to provide corrosion resistance, nitrogen, and carbon if present, must be kept in solid solution. Treatment at the dissolution temperature will remove any precipitated nitrides and carbides in the alloy, and in order to prevent sensitisation, i.e. precipitation of nitrides and carbides if carbon is present, the assembly component is quenched, i.e. cooled from the temperature of 900° C. to 500° C. in less than 60 seconds, in order to prevent precipitation of nitrogen and carbides if carbon is present. With this treatment corrosion resistance is ensured. However, treatment at the dissolution temperature corresponds to an annealing process and any core strength, e.g. obtained from a prior cold deformation, is reduced since cold deformation in the material is annihilated. The improved tensile strength observed following cold deformation of the assembly component of the invention can advantageously be performed at a temperature in the range of 0° C. to 200° C. and it is preferred that the cold deformation is performed at a temperature in the range of 0° C. to 200° C., e.g. below 100° C., in particular at ambient temperature, e.g. at a temperature in the range of 0° C. to 50° C. When the cold deformation is performed at a temperature at or below 200° C., such as at or below 100° C., e.g. at ambient temperature, the assembly of the assembly component with an inner tubular member and an outer tubular member can be performed without concerns caused by different thermal expansion coefficients of the alloy of the assembly component and the inner and the outer tubular member.

In another aspect the invention relates to an assembly of an assembly component of the invention, an inner tubular member having a peripheral surface and an outer tubular member having an interior surface, wherein the assembly component is positioned between the inner tubular member and the outer tubular member so that the inner surface of the assembly component abuts the peripheral surface of the inner tubular member and the outer surface of the assembly component abuts the interior surface of the outer tubular member. Any assembly component of the invention may be employed in the assembly of the invention. The tubular members may have any tubular size and shape as desired. For examples, the tubular members may be straight cylindrical tubes. The inner tubular member and the outer tubular member may have the same or different diameters, e.g. inner diameters and outer diameters.

In a preferred embodiment the assembly component has been subjected to cold deformation after positioning between the inner tubular member and the outer tubular member. For example, the assembly component may be positioned between the inner and the outer tubular member and the inner and the outer tubular members are rotated in opposite directions in a lateral plane in order to subject the assembly component to cold deformation. Thereby the advantageously high tensile strength is obtained for the assembly component and a gas tight seal is provided for the assembly. Since the assembly component has a high content of chromium and is free from sensitisation, i.e. the assembly component is free from nitride compounds, the assembly is resistant to corrosion.

In embodiments of the invention the assembly has components with complementary helical threads for assembling the respective components. For example, the inner tubular member may comprise an external helical thread and the outer tubular member may comprise an internal helical thread complementary to the external helical thread. Complementary helical threads ensure a tighter assembly between the respective components, which thereby provides a synergistic improvement of the gas tight coupled afforded by the assembly component of the invention. When components comprise complementary helical threads the components may further have an outer circumferential shape facilitating rotation of the respective component. For example, the outer circumferential shape may be polygonal, e.g. square or hexagonal, allowing rotation with a wrench or the like. When components have outer circumferential shapes facilitating rotation and complementary helical threads cold deformation of the assembly component is facilitated by rotating the respective components in opposite directions.

The inner tubular member may comprise an external helical thread and the outer tubular member may comprise an internal helical thread complementary to the external helical thread. A tubular member or a component with an internal helical thread may be referred to as a "female connector", and a tubular member or a component with an external helical thread may be referred to as a "male connector". The assembly of the invention may further comprise any additional member or component for assembling the assembly. For example, the assembly may additionally comprise a male connector or a additional female connector, or the assembly may comprise both an additional male connector and an additional female connector. In a specific embodiment the inner tubular member is a male connector. In another embodiment the outer tubular member is a female connector.

The assembly may contain any additional components as desired. For example, the assembly may comprise additional connectors for improved interaction between the inner and the outer tubular members and the assembly component. In a specific embodiment the outer tubular member comprises an external helical thread, e.g. the outer tubular member is a male connector, and the assembly further comprises a connector having an internal helical thread complementary to the external helical thread, i.e. a female connector. This embodiment simplifies assembly of the assembly, since the connector can be rotated independently of the tubular members. The female connector may also be referred to as a "nut".

In a further embodiment the assembly has an outer tubular member having a first and a second external helical thread, which may be identical, and a first and a second connector which have internal helical threads complementary to the first and the second external helical threads, and the assembly further comprises an additional assembly component of the invention. This embodiment allows flexible connection of two tubes, e.g. as the inner tubular members, since outer tubular member and the first and the second connector may all be rotated independently, and the may be rotated independently of the inner tubular members.

In another embodiment the assembly comprises a further, or second, assembly component and the first assembly component also is the outer tubular members. In this embodiment the first assembly component is a "front ferrule", and the second assembly component is a "back ferrule".

The inner tubular member and outer tubular members may be chosen freely, e.g. with respect to their inner and outer diameters, as long as the assembly of the invention can be provided. Likewise, the assembly component of the invention is chosen to fit between the outer diameter of the inner tubular member and the inner diameter of the outer tubular member. For example, the tubes may have any diameter appropriate according to standards of the American Standards Association or according to European standards, e.g. the diameter may be about 1 mm or less, or the diameter may be about 24" or more. In an embodiment the outer diameter of the annular shape is in the range of 3 mm to 50 mm. In an embodiment the annular shape has an axial length in the range of 2 mm to 500 mm.

In a further aspect the invention relates to a kit of parts comprising an outer tubular member, one or more assembly components of the invention, and a connector. It is preferred that the outer tubular member has an external helical thread, and that the connector has an internal helical thread complementary to the external helical thread of the outer tubular member. When the kit of parts comprises more than one assembly component a first assembly component may be a front ferrule and a further assembly component may be a back ferrule.

It should be understood that combinations of the features in the various embodiments are also contemplated, and that the various features, details and embodiments may be combined into other embodiments. In particular, it is contemplated that all definitions, features, details, and embodiments regarding the method of the invention are also relevant for embodiments of the assembly component of the invention which are not explicitly described and vice versa. Likewise, any embodiment of the assembly component may be employed in any embodiment of the assembly of the invention. Any embodiment of the assembly component may be included in the kit of parts, and any assembly of the invention is likewise relevant for the kit of parts.

Reference to the figures serves to explain the invention and should not be construed as limiting the features to the specific embodiments as depicted.

BRIEF DESCRIPTION OF THE FIGURES

In the following the invention will be explained in greater detail with the aid of an example and with reference to the schematic drawings, in which.

DETAILED DESCRIPTION OF THE INVENTION

Figure 1:
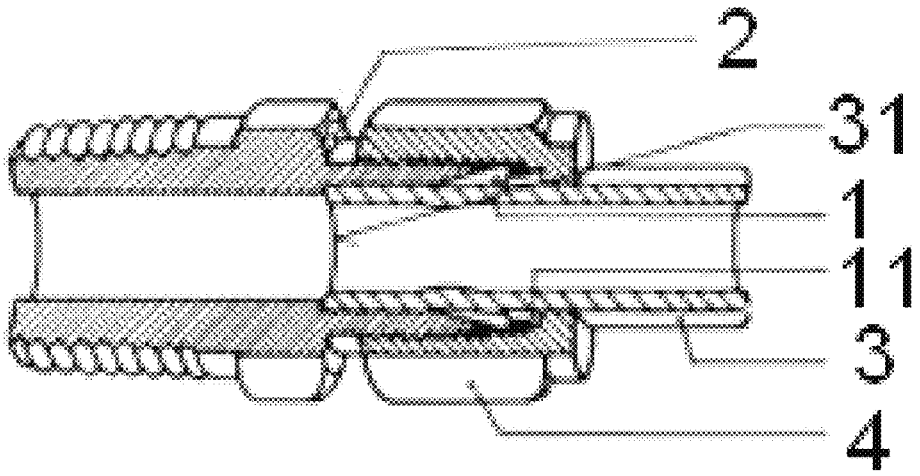
FIG. 1 shows a cross-section of an assembly of the invention.

The present invention relates to an assembly component and to a method of producing the assembly component, and when the term "component" is used in this document it may refer to the assembly component of the invention or to the component treated in the method of the invention. Any embodiment of the assembly component may be produced in the method of the invention. In another aspect the invention relates to an assembly involving an assembly component of the invention. Any assembly component of the invention may be included in the assembly of the invention, but the assembly may also include components not of the invention. In yet a further aspect the present invention relates to a kit of parts comprising the assembly component.

The component is of an alloy based on iron, nickel and/or cobalt containing at least 10% (w/w) chromium, e.g. an iron based alloy with 10.5% (w/w) chromium or more, and the chromium content provides that an oxide layer will form on the surface of the component. The oxide layer provides corrosion resistance and an alloy based on iron, nickel and/or cobalt containing at least 10% chromium may also be referred to as a passive alloy. By the term "passive" in connection with alloys or metals is thus to be understood an alloy, which has a protective oxide layer. A passive alloy can be both self-passivating or be passivated as a consequence of a process to which the alloy is subjected. Belonging to the group of self-passivating alloys are those, which have a strong affinity to oxygen (e.g. Cr, Ti, V), including alloys containing such alloying elements, e.g. stainless steel which essentially is an iron based alloy containing at least 10.5% (w/w) Cr. It is also contemplated that the component may be of an alloy containing at least 10% (w/w) vanadium or at least 10% (w/w) titanium or 10% (w/w) of any combination of chromium, vanadium and titanium.

Unless otherwise noted a percentage in relation to a metal element or a non-metallic element in an alloy, is by weight and is denoted % (w/w). When the assembly component of the invention has a microhardness deviating with up to 15% from the average hardness the assembly component has a uniform nitrogen content over the thickness of assembly component and the percentage, % (w/w) is by the total weight of material. However, when percentage, expressed as % (w/w), is stated for the hardened layer the percentage is based on the weight of the hardened layer. In general, a content of nitrogen in the alloy will be measured relative to the immediate surroundings of the measurement, and this measurement thus represents the nitrogen content of the hardened layer. Unless otherwise noted a composition of a mixture of gasses is on an atomic basis and may be provided as a percentage or in ppm (parts per million). With respect to compositions of alloys or gasses unavoidable impurities may also be present, even if this is not specifically mentioned.

In terms of the invention an "alloying element" may refer to a metallic element or a non-metallic element in the alloy. In particular, alloys of relevance in the method of the invention comprise an element, e.g. a metallic element, that may form nitrides and/or carbides with present nitrogen and carbon, respectively. The method of the invention advantageously provides a hardened layer on an assembly component, e.g. a nitrogen saturated component, free from nitrides and carbides of alloying elements. It is however also contemplated in the invention that an alloy may comprise only a single metallic element capable of forming nitrides and/or carbides. An alloy may also comprise other elements, such as semi-metallic elements, inter-metallic elements, or non-metallic elements. Alloying elements capable of forming nitrides and/or carbides may typically be metallic elements providing corrosion resistance to the alloy due to formation of a passive oxide layer with the alloying element. The terms "nitride" and "carbide" as used in the context of the invention refer to nitrides and carbides formed between alloying elements and nitrogen and carbon, respectively. An exemplary nitride is chromium nitride, CrN or $Cr_2N$ although terms "nitride" and "carbide" are not limited to nitrides and carbides with chromium.

By the term "sensitisation" is to be understood that nitrogen or carbon have formed nitrides and carbides, respectively, by reaction with one or more alloying elements otherwise utilised to form the protective oxide layer on the surface, as for example chromium in stainless steel. When sensitisation occurs, the free content of the alloying element, such as chromium, in solid solution is lowered to a level, which is no longer sufficient to maintain a complete protective oxide layer, which means that the corrosion characteristics are deteriorated.

In the method of the invention the component is treated at a dissolution temperature of at least 1000° C. A temperature of at least 1000° C. may also be referred to as a temperature above the solubility temperature for carbide and/or nitride. By the term "solubility temperature for carbide and/or nitride" is to be understood the temperature at which nitrides/carbides are not stable, and where already formed nitrides/carbides are dissolved. In general, alloys comprising metallic alloying elements capable of forming nitrides and/or carbides will have a temperature interval in which nitrides and/or carbides may form when nitrogen and carbon, respectively, are present. Thus, above this temperature, nitrides and carbides will not form, and already formed nitrides/carbides are dissolved. When nitrides or carbides exist, i.e. sensitisation has occurred, these carbides can generally only be removed by exposing the sensitised metal to a temperature above the austenisation temperature. Furthermore, such alloys have a temperature below the temperature interval, where nitrides and carbides will not form, although nitrides or carbides already formed in an alloy cannot be removed at the low temperature.

The dissolution temperature may also correspond to the austenisation temperature of the alloy of the component. The "austenisation temperature" is typically the temperature used when heat treating an alloy in order to dissolve carbides, and "austenisation temperature" may thus correspond to the "solubility temperature for carbide". At the austenisation temperature the alloy is in the austenitic phase. The temperature at which a steel alloy changes phase from ferrite to austenite is typically at a somewhat lower temperature than the austenisation temperature.

By the term "cold deformation" (also named "cold working") is to be understood a plastic deformation induced in the material by external forces at a temperature below the recrystallisation temperature of the material. Cold deformation may be provided by any shape change, such as forging, extrusion, shaping, drawing, pressing, or rolling, or by a combination of these processes. In the context of the invention the hardness is generally the $HV_{0.05}$ as measured according to the DIN EN ISO 6507 standard. If not otherwise mentioned the unit "HV" thus refers to this standard. The hardness may be recorded for a cross-section and it may be noted with respect to the depth of the measurement. A hardness recorded in a cross-section is, in the context of the invention, referred to as a "microhardness". In general, a microhardness measurement requires about 5 μm of material so that multiple microhardness measurements are possible for a material having a thickness of 100 μm. In an embodiment of the invention at least 5 microhardness measurements are recorded in order to determine an average microhardness and deviations from the average microhardness. When at least 5 microhardness measurements are recorded these should be recorded over the thickness of relevance for the average microhardness of interest. For example, the at least 5 microhardness measurements could include a measurement near the centre of the material, 1 microhardness measurement near each surface of the material and 2 microhardness measurements between the centre and the surface of the material. For determining an average microhardness and the deviation from the average microhardness 5 measurements are considered sufficient but more measurements may be included as desired. Measurement of microhardness typically has an uncertainty of about ±10% so that microhardness measurements providing a deviation of up to 10% from the average hardness is considered to represent a uniform material. However, a microhardness measurement may represent an outlier that should not be included in the determination of the average microhardness and should not be considered for the deviation from the average microhardness. The skilled person will know how to identify an outlier.

In the context of the invention the "depth" is the distance from the surface. When the hardness is recorded at a cross-section the measurement is considered to represent a homogeneous sample with respect to the direction of the pressure applied. Alternatively, the hardness may be obtained from measurements at the surface, and the measurement may thus represent an average of several different values of hardness, i.e. at different depths. In the context of the invention a hardness measurement recorded in a cross-section at a depth of about 1 μm is considered to provide the actual hardness of the surface of the material. However, as an effect of the fact that nitrogen may be dissolved from the surface to have a deviation over the thickness of up to 15% the hardness may be generally uniform over the cross-section of the assembly component, including the surface hardness.

Figure 2A:
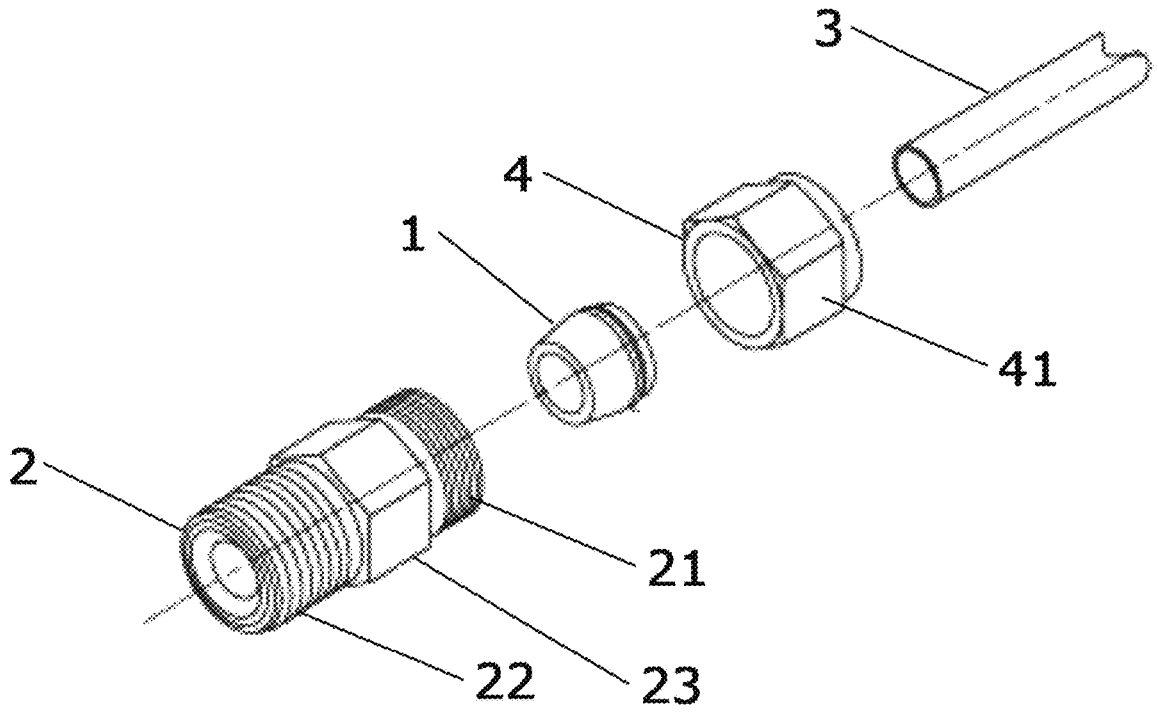
FIGS. 2A and 2B show an exploded view of an assembly of the invention.
Figure 2B:
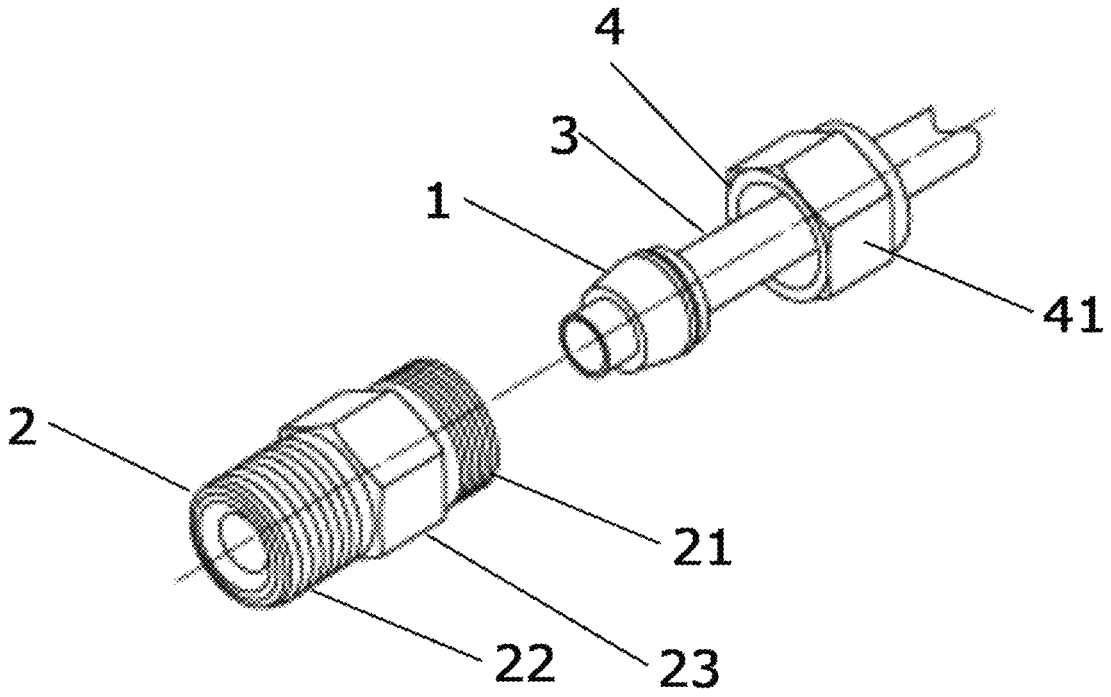

A cross-section of an assembly of the invention is depicted in FIG. 1, and an exploded view of the assembly is shown in FIG. 2. FIG. 1 and FIG. 2 show the assembly component 1, which has a frustoconical shape, between an outer tubular member 2 having a first external helical thread 21 and a second external helical thread 22, and an inner tubular member 3; the end 31 of the inner tubular member 3 is shown in FIG. 1. The inner tubular member 3 is a straight cylindrical tube. The assembly further has a connector 4 having an internal helical thread (not shown), which is complementary to the first external helical thread 21 of the outer tubular member 2. Thus, the outer tubular member 2 is a "male connector", and the connector 4 is a "female connector". In FIG. 1 the assembly is assembled but in FIG. 2 the assembly is not assembled. In FIG. 2A the components of the assembly are not assembled but in FIG. 2B the components are partly assembled. Thus, in FIG. 2B the assembly component 1 is mounted on the inner tubular member 3 to allow the peripheral surface of the inner tubular member 3 to abut the inner surface of the assembly component 1. The assembly in FIG. 1 further has a back ferrule 11, which is also an assembly component of the invention.

Thus, the assembly is assembled by pushing the outer tubular member 2 and the connector 4 towards each other to bring them into contact and rotating the outer tubular member 2 and the connector 4 in opposite directions with respect to each other. For example, the outer tubular member 2 may be fixed and the connector 4 rotated, or vice versa, or both the outer tubular member 2 and the connector 4 may be rotated but in opposite rotational directions. Upon assembly the first external helical thread 21 of the outer tubular member 2 will be screwed into the internal helical thread of the connector 4 thereby subjecting the assembly component 1 to cold deformation and providing a gas tight seal. The external helical thread 22 of the outer tubular member 2 may then be joined with a further tubular member (not shown) with an assembly component and a connector having an internal helical thread complementary to the second external helical thread 22 of the outer tubular member 2. Both the outer tubular member 2 and the connector 4 have a hexagonal outer circumferential shapes 23,41, which may be rotated using a standard wrench.

Figure 3A:
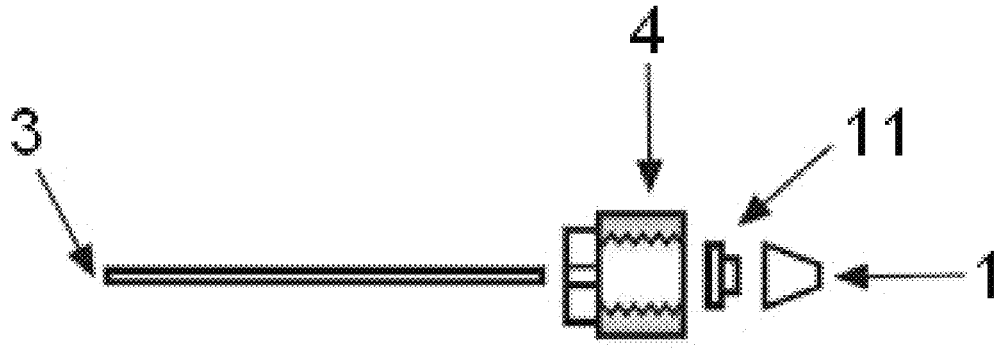
FIGS. 3A and 3B show an assembly of the invention.
Figure 3B:
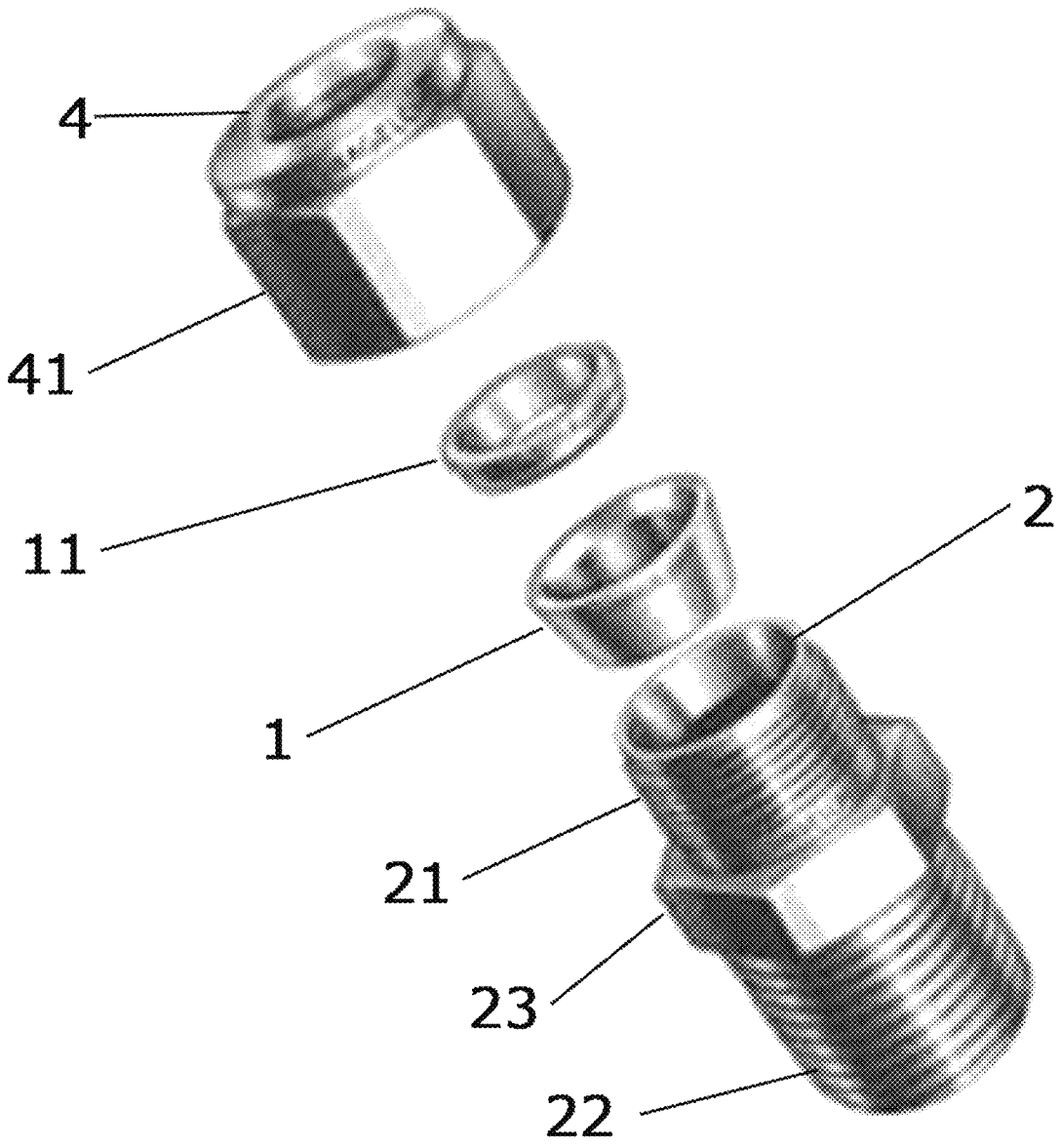

Parts of an assembly of the invention with a back ferrule 11 are illustrated in FIG. 3. Thus, FIG. 3A shows the assembly component 1 and the back ferrule 11, the inner tubular member 3 and the connector 4. FIG. 3B shows, in a perspective view, the assembly component 1 and the back ferrule 11, the outer tubular member 2 and the connector 4. It is to be understood that the assembly of the invention comprises the parts not shown in FIG. 3 as appropriate.

EXAMPLES

Example 1

An annular component of AISI 316 stainless steel having a thickness between the inner surface and the outer surface of 1.50 mm was provided. The annular component was heated to 1150° C. and subjected to an atmosphere of $N_2$ with a partial pressure of 0.5 bar at a dissolution temperature of 1050° C. The duration was 4 hours. The annular component was quenched in argon at 5 bar to ambient temperature to provide the assembly component.

Figure 4:
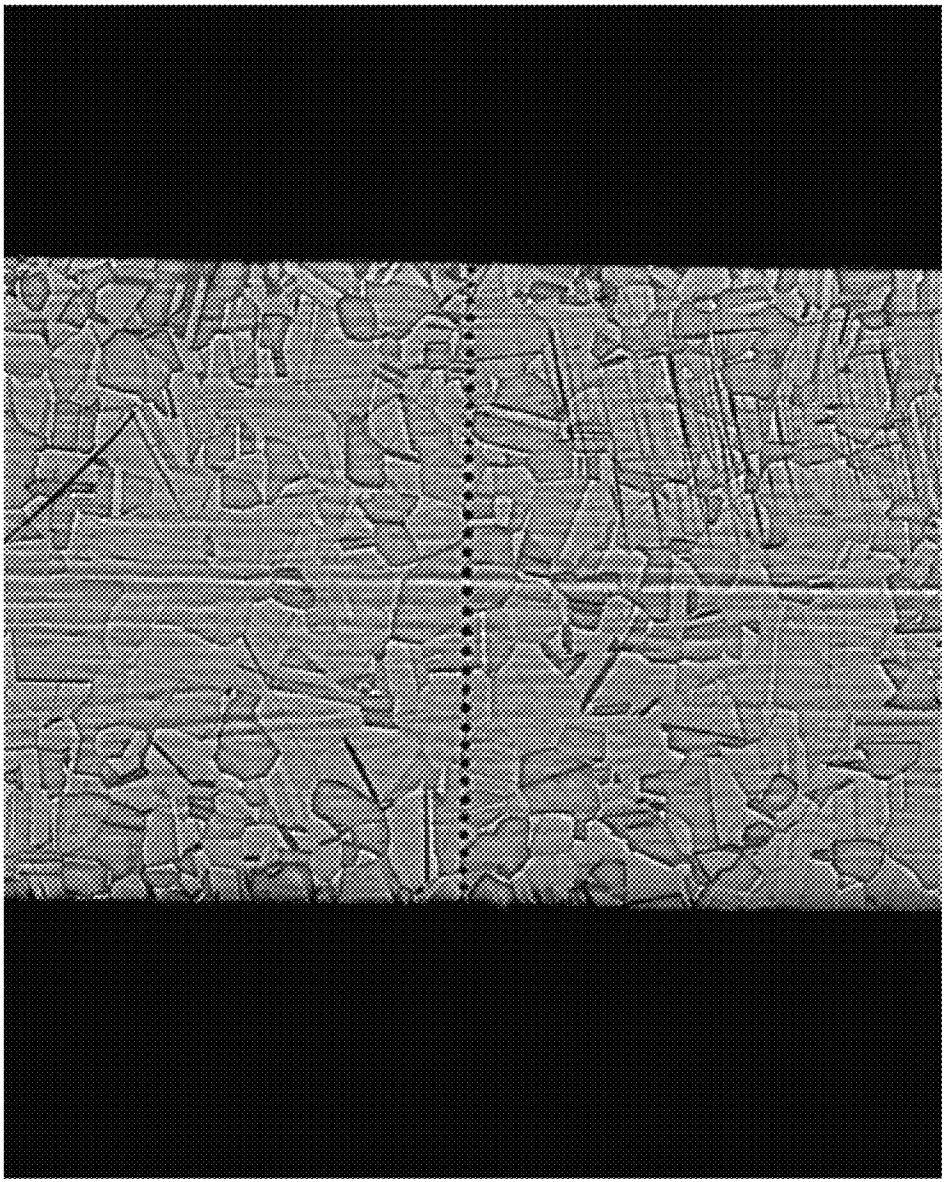
FIG. 4 shows a cross-section of an assembly component of the invention.
Figure 5:
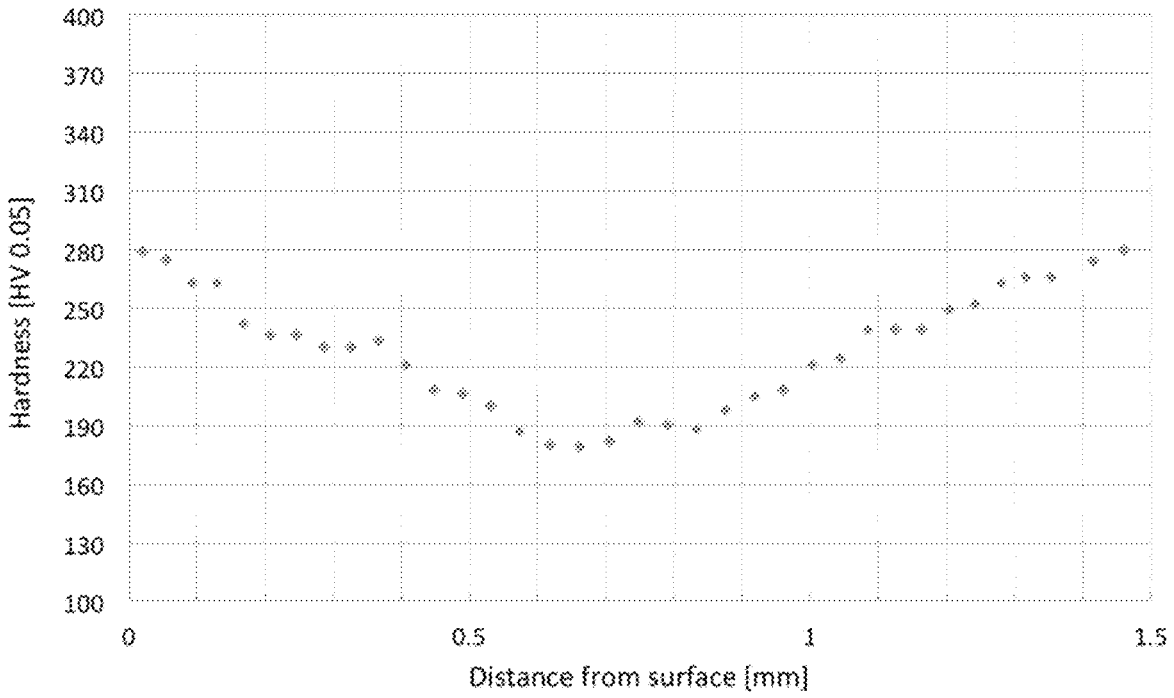
FIG. 5 shows a microhardness profile of an assembly component of the invention.

The cross-section of the treated assembly component was exposed and the microhardness profile was determined. A photo of a cross-section of the assembly component is shown in FIG. 4. FIG. 4 shows how the material of the assembly component is completely austenised and free of any nitrides or crystal structures. The microhardness profile is shown in FIG. 5, which shows a that the hardened layer extended to a depth above 100 μm, at which point the microhardness was about 260 $HV_{0.05}$. The assembly component had a core microhardness of about 190 $HV_{0.05}$.

Example 2

Figure 6:
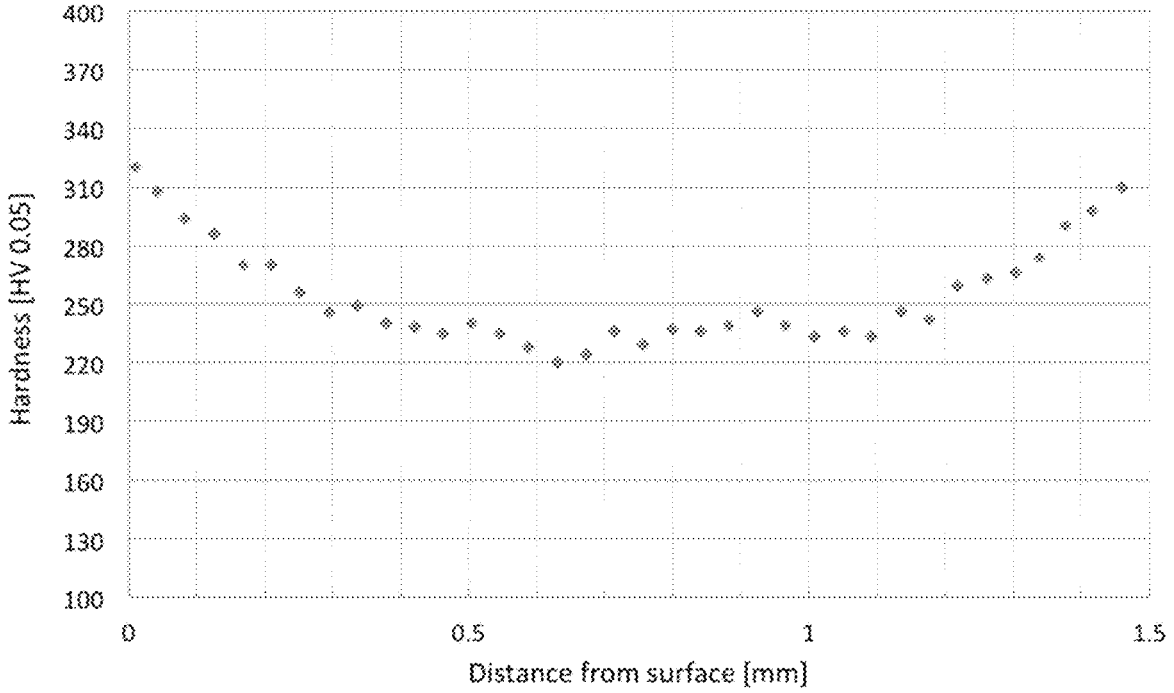
FIG. 6 shows a microhardness profile of an assembly component of the invention.

The process of Example 1 was modified by increasing the duration to 6 hours. Thereby nitrogen was inserted to a greater depth as shown in FIG. 6 where a hardened layer of 300 μm is evident, since at the depth of 300 μm the microhardness was about 250 $HV_{0.05}$. By increasing the duration to 8 hours sufficient nitrogen was also dissolved though the thickness of the assembly component to increase the core microhardness to about 240 $HV_{0.05}$. This core microhardness corresponds to a nitrogen content of approximately 0.4% (w/w).

Example 3

Figure 7:
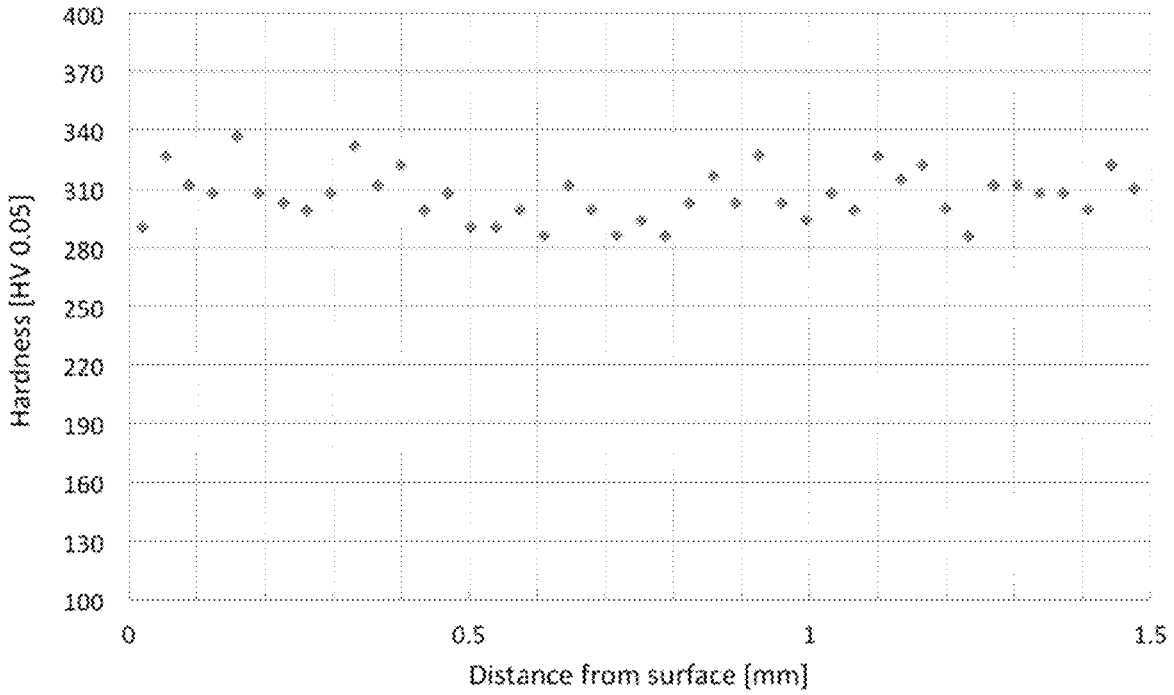
FIG. 7 shows a microhardness profile of an assembly component of the invention.

An annular component of AISI 316 stainless steel having a thickness between the inner surface and the outer surface of 1.50 mm was provided, and the process of Example 1 was repeated but with a duration of 8 hours in order to saturate the assembly component with nitrogen over its thickness. The partial pressure of $N_2$ was 1.1 bar, which provided a microhardness of 310±30 $HV_{0.05}$ corresponding to a nitrogen content of about 0.8% (w/w) in the assembly component. The hardness profile is depicted in FIG. 7.

The invention claimed is:

1. An assembly component for providing a gas tight seal, the assembly component being of an austenitic alloy based on iron, nickel, and/or cobalt and containing at least 10% (w/w) chromium, the assembly component having an annular shape with an inner surface and an outer surface and a thickness between the inner surface and the outer surface in the range of 0.1 mm to 5 mm, the austenitic alloy having a content of nitrogen in solid solution providing a microhardness in the range of 250 $HV_{0.05}$ to 370 $HV_{0.05}$ at a depth from the surface in the range of 0 μm to 100 μm.

2. The assembly component according to claim 1, wherein the microhardness is in the range of 280 $HV_{0.05}$ to 320 $HV_{0.05}$ at a depth from the surface in the range of 0 μm to 100 μm.

3. The assembly component according to claim 1, wherein the assembly component has an average microhardness in the range of 280 $HV_{0.05}$ to 320 $HV_{0.05}$ over the thickness of the assembly component as calculated from at least 5 microhardness measurements, where the at least 5 microhardness measurements deviate up to 15% from the average microhardness.

4. The assembly component according to claim 1, wherein the nitrogen content is in the range of 0.1% (w/w) to 0.8% (w/w) at a depth from the surface in the range of 0 μm to 100 μm.

5. The assembly component according to claim 3, wherein the nitrogen content is in the range of 0.1% (w/w) to 0.8% (w/w) over the thickness of the assembly component.

6. The assembly component according to claim 5, wherein the nitrogen content deviates by up to 10% from the average nitrogen content over the thickness of the assembly component.

7. The assembly component according to claim 1, wherein the outer diameter of the annular shape is in the range of 3 mm to 50 mm.

8. The assembly component according to claim 1, wherein the annular shape has an axial length in the range of 2 mm to 500 mm.

9. The assembly component according to claim 1, wherein the assembly component has frustoconical annular shape defining a narrow end and a wide end.

10. The assembly component according to claim 1, wherein the assembly component is free from nitride compounds.

11. The assembly component according to claim 1, wherein the austenitic alloy is an austenitic stainless steel.

12. An assembly of the assembly component according to claim 1, an inner tubular member having a peripheral surface and an outer tubular member having an interior surface, wherein the assembly component is positioned between the inner tubular member and the outer tubular member so that the inner surface of the assembly component abuts the peripheral surface of the inner tubular member and the outer surface of the assembly component abuts the interior surface of the outer tubular member.

13. The assembly according to claim 12, wherein the assembly component has been subjected to cold deformation after positioning between the inner tubular member and the outer tubular member.

14. The assembly according to claim 12, wherein the inner tubular member comprises an external helical thread and the outer tubular member comprises an internal helical thread complementary to the external helical thread.

15. The assembly according to claim 12, wherein the outer tubular member comprises an external helical thread and the assembly further comprises a connector having an internal helical thread complementary to the external helical thread.

16. A kit of parts comprising an outer tubular member, one or more assembly components according to claim 1, and a connector.

17. The kit of parts according to claim 16, wherein the outer tubular member has an external helical thread, and that the connector has an internal helical thread complementary to the external helical thread of the outer tubular member.

18. The kit of parts according to claim 17, wherein the outer tubular member and the connector have an outer circumferential shape facilitating rotation of the outer tubular member and the connector.

* * * * *